US006640710B1

(12) United States Patent
Hesselmann et al.

(10) Patent No.: US 6,640,710 B1
(45) Date of Patent: Nov. 4, 2003

(54) INK BAR FOR INK DUCTS IN PRINTING MACHINES

(75) Inventors: Theo Hesselmann, Vogtareuth (DE); Harald Kretzinger, Munich (DE)

(73) Assignee: Planatol Klebetechnik GmbH (DE)

( * ) Notice: Subject to any disclaimer, the term of this patent is extended or adjusted under 35 U.S.C. 154(b) by 0 days.

(21) Appl. No.: 10/110,269

(22) PCT Filed: Nov. 4, 2000

(86) PCT No.: PCT/EP00/10859

§ 371 (c)(1),
(2), (4) Date: Apr. 9, 2002

(87) PCT Pub. No.: WO01/42015

PCT Pub. Date: Jun. 14, 2001

(30) Foreign Application Priority Data

Dec. 8, 1999 (DE) ..... 299 21 450 U

(51) Int. Cl.[7] ..... B41F 31/02
(52) U.S. Cl. ..... 101/364; 101/366
(58) Field of Search ..... 101/364, 335, 101/204, 208, 210, 315, 321, 326, 340, 344, 347, 355, 356, 360, 363, 365, 366, 367, 370, 377, 380, 381, 386

(56) References Cited

U.S. PATENT DOCUMENTS 4,010,683 A * 3/1977 Lambert et al. ..... 101/366
4,388,864 A * 6/1983 Warner ..... 101/148
4,577,203 A * 3/1986 Kawamura ..... 347/30
5,027,706 A * 7/1991 Niemiro et al. ..... 101/366
5,943,078 A * 8/1999 Nishimoto et al. ..... 347/89

FOREIGN PATENT DOCUMENTS

| | | |
|---|---|---|
| DE | 507 531 | 9/1930 |
| DE | 32 19 786 | 12/1982 |
| DE | 195 12 727 | 10/1996 |
| DE | 0 768 175 | 4/1997 |
| DE | 196 00 796 | 7/1997 |
| DE | 199 03 167 | 9/1999 |

OTHER PUBLICATIONS

1970, Roland–Farbpumpe auch für kleine Auflagen.

* cited by examiner

*Primary Examiner*—Andrew H. Hirshfeld
*Assistant Examiner*—Hoai An D. Nguyen
(74) *Attorney, Agent, or Firm*—McGlew and Tuttle, P.C.

(57) ABSTRACT

An ink bar is provided with a control device for bringing back printing ink into the ink duct (20) of a printing machine when required. The aim of the invention is to arrange all the essential function pieces in a space-saving manner, whereby said pieces are used for adjusting the ink level. The ink bar (1) is made from a hollow rod prifile having an undercut groove (4) on the lateral outer wall. Said groove serves for receiving cables (5). Discharge valves (8) and the supply device of an ink valve are arranged in the inner chamber of the rod profile. The ink valve is coupled to a sensor (9) and said valves are connected by means of the cable (5).

6 Claims, 1 Drawing Sheet

INK BAR FOR INK DUCTS IN PRINTING MACHINES

FIELD OF THE INVENTION

The present invention pertains to an ink bar with a control for feeding printing ink into the ink duct of a printing press as needed.

BACKGROUND OF THE INVENTION

In prior-art units, the ink bar extends at a spaced location from and at right angles above the ink duct. A sensor located at the bar determines the height of the ink level by means of ultrasound and reports the lowering to the control via a terminal box. The control switches on and off an ink valve for refilling the ink duct. The devices located on the ink bar are connected to the control members via cables and tubes, which are usually located at a considerable distance from the ink bar. These long cables and the tubes are in the way and are also expensive.

SUMMARY AND OBJECTS OF THE INVENTION

The basic object of the present invention is to develop an ink bar at which all essential functioning parts for controlling the ink level are arranged in a compact manner and are connected to one another by partially hidden cables, wherein the amount of the cables necessary in the state of the art is substantially reduced.

The essence of the present invention is that the ink bar comprises a hollow bar section or extruded section with at least one groove designed as an undercut groove in a lateral outer wall for receiving cables, with the interior space of which adjustable discharge valves as well as the inlet of an ink valve are connected, and that a sensor that can determine the printing ink level as well as the ink valve coupled with a terminal box are arranged on the bar section or extruded section, and the two are connected via the cable located in the groove.

It proved to be advantageous to arrange various types of holding parts at both ends of the bar section or extruded section for fastening on the frame walls of the printing press or of the ink duct. These holding parts or screws or plugs close the hollow space of the bar section or extruded section on the front side.

A Roland ink pump, which shows very generally a distributor tube with ink duct and level controller, is described in the journal Druckwelt, 15/1970. This arrangement as well as the ink distributor arrangements described in the other documents mentioned in the Search Report are not suitable for accomplishing the above-mentioned object of the present invention. No ink bar that would comprise a hollow bar section or extruded section with at least one groove undercut in a lateral outer wall for receiving cables can be found in the state of the art at all.

The ink bar according to the present invention can be manufactured and supplied as a prefabricated assembly unit, so that only the connections for ink, electric cables and air are then to be arranged in order to make the ink bar ready to operate. This substantially reduces the assembly effort.

It is recommended within the framework of one embodiment to integrate the control unit in the ink valve. It is also possible to integrate the sensor, the ink valve and the control unit in one assembly unit fastened on the bar section or extruded section. A solenoid valve needed to open the ink valve may also be integrated in the assembly unit. One or more switching elements now make possible the switching on and off, manual filling, automatic filling as well as the display in operating and disturbance functions.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
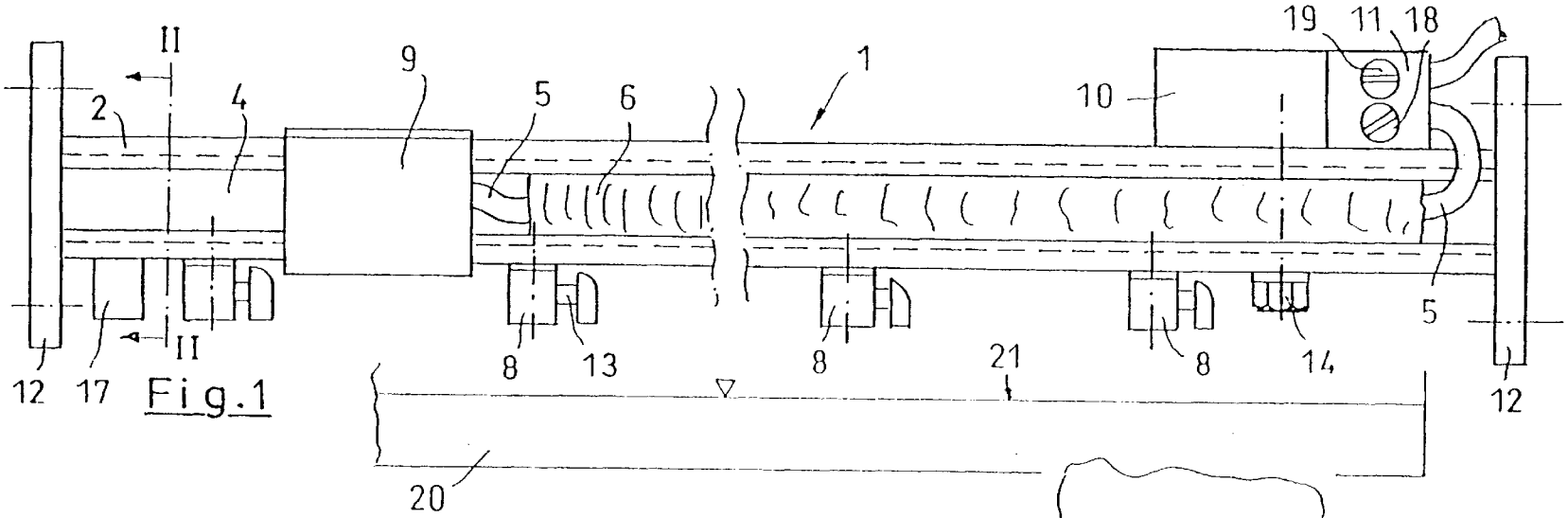
FIG. 1 is a side view of an ink bar with the control elements connected therewith.

Referring to the drawings in particular, the ink bar 1 shown symbolically in FIG. 1 comprises a hollow bar section or extruded section 2, at both ends of which holding parts 12 for fastening on the side walls of a printing press are arranged. The holding parts 12 cover the hollow space 7 of the bar section or extruded section. However, the latter may also be closed by screws, plugs or the like.

Discharge valves 8 arranged at spaced locations from one another with valve screws or valve cocks 13 are located on the underside of the bar section or extruded section 2. These discharge valves 8 are connected to the interior space 7 of the bar section or extruded section. The printing ink can flow off into the ink duct 20 located beneath the ink bar I through the downwardly directed hole. Valve screws or valve cocks, which can change the internal cross section of the discharge valve, are designated by 13. The printing ink is fed in via an ink valve 10, which is arranged at one end of the ink bar 1. The printing ink reaches the interior space 7 of the bar section or extruded section 2 through hollow screws 14 and passes through a plurality of discharge valves 8. To prevent the pressure of the ink from decreasing within the interior space, the discharge valve 8 located closest to the ink valve 10 is constricted to a greater extent than the discharge valve 8 located farthest from the ink valve 10.

Figure 2:
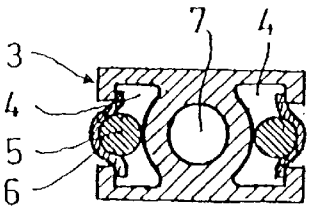
FIG. 2 is a cross sectional view through a bar section or extruded section for forming the ink bar.
Figure 3:
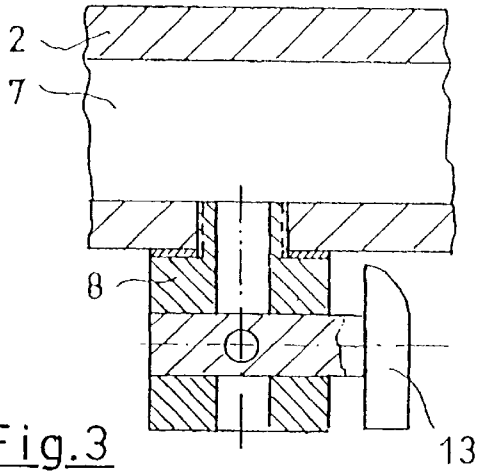
FIG. 3 is a partial detail of the ink bar with a discharge valve.
Figure 4:
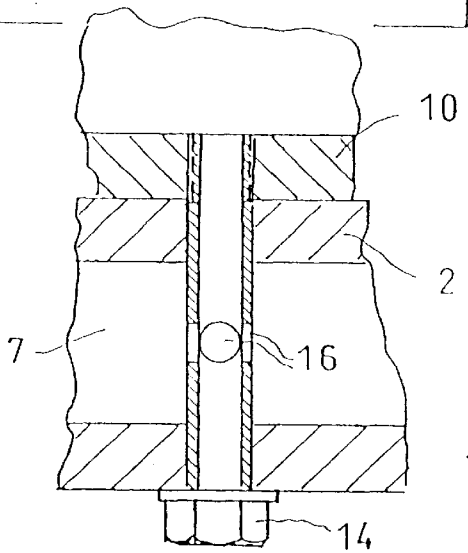
FIG. 4 is a partial detail of the ink bar with the fastening of the ink valve.

Through undercut grooves 4 cables 5 as well as a cover 6 for these cables 5 can be inserted. The through undercut grooves 4 are located in the lateral outer walls 3 of the bar section or extruded section 2 (see FIG. 2).

The cable is connected here to a sensor 9, which is fastened on the bar section or extruded section 2 in a displaceable or freely positionable manner. As in the state of the art, the sensor 9 determines, e.g., the height of the ink level 21 in the ink duct 20, e.g., by means of ultrasound and reports this result to a control, unit 11, which is connected to the ink valve 10 in the exemplary embodiment. However, the control unit 11 may also be arranged at a closely spaced location outside the ink bar 1. The ink valve 10 is switched on and off via the control unit 11 supplied with electric power in order to maintain the printing ink level 21 at a constant value.

In addition, an cnergizable valve, e.g., a solenoid valve, which brings about the opening and closing of the ink valve 10, is integrated within the ink valve 10.

In addition, the ink bar 1 has, in any desired area, an overpressure relief valve 17, which responds when overpressure of ink develops in the interior space 7 of the bar section or extruded section 2 and lets the printing ink escape into the ink duct 20.

The switching on of the individual control members may also be performed by manual adjustment 18 in the area of the control unit 11. The power supply terminals are symbolically designated by 19.

While a specific embodiment of the invention has been shown and described in detail to illustrate the application of the principles of the invention, it will be understood that the invention may be embodied otherwise without departing from such principles.

What is claimed is:

1. An ink bar arrangement comprising:

a hollow section that is one of a bar section and an extruded section, said hollow section having a groove undercut in a lateral outer wall with an interior space;

cables disposed in said groove;

adjustable discharge valves connected to said interior space;

an ink valve with an inlet connected to said interior space;

a control unit, said ink valve being coupled with said control unit;

a printing ink level sensor, said sensor and said ink valve coupled with said control unit being arranged on said bar section or extruded section, said sensor and said ink valve coupled with said control unit being connected via said cables located in said groove.

2. An ink bar in accordance with claim 1, wherein the control unit is integrated within the ink valve.

3. An ink bar in accordance with claim 1, wherein said sensor, said ink valve and said control unit are integrated in one assembly unit fastened on said bar section or extruded section.

4. An ink bar in accordance with claim 3, wherein an energizable valve needed for opening the ink valve is integrated within the assembly unit.

5. An ink bar in accordance with claim 1, further comprising: holding parts respectively arranged at both ends of the bar section or extruded section for fastening on the frame walls of the printing press or on the ink duct.

6. An ink bar in accordance with claim 1, further comprising:

a divided ink duct; and another hollow bar section or extruded section, with at least one groove undercut in a lateral outer wall with an interior space, further cables in said groove of said another bar section or extruded section with adjustable discharge valves connected to said interior space, an ink valve with an inlet connected to said interior space, a control unit and a sensor for determining the printing ink level, said hollow bar section or extruded section and said another hollow bar section or extruded section forming an arrangement of a plurality of ink bars next to one another in connection with one another, above said ink duct.

* * * * *